US008605934B2

(12) United States Patent
Hagberg et al.

(10) Patent No.: US 8,605,934 B2
(45) Date of Patent: Dec. 10, 2013

(54) WIRED HEADSET ADAPTABLE FOR LEFT AND RIGHT EAR USE

(75) Inventors: Ola Hagberg, Bunkeflostrand (SE); Ole Birch, Naerum (DK); Kim Ziersen Jakobsen, Copenhagen (DK)

(73) Assignee: GN Netcom A/S (DK)

( * ) Notice: Subject to any disclaimer, the term of this patent is extended or adjusted under 35 U.S.C. 154(b) by 174 days.

(21) Appl. No.: 13/122,478

(22) PCT Filed: Oct. 3, 2008

(86) PCT No.: PCT/DK2008/000342
§ 371 (c)(1),
(2), (4) Date: Jun. 2, 2011

(87) PCT Pub. No.: WO2010/037385
PCT Pub. Date: Apr. 8, 2010

(65) Prior Publication Data
US 2011/0222719 A1 Sep. 15, 2011

(51) Int. Cl.
*H04R 25/00* (2006.01)

(52) U.S. Cl.
USPC ..... 381/375; 381/379; 381/381; 379/430

(58) Field of Classification Search
USPC ..... 381/370, 374, 375, 379, 381, 390; 379/430, 431; 455/569.1, 575.2
See application file for complete search history.

(56) References Cited

U.S. PATENT DOCUMENTS

| | | | | |
|---|---|---|---|---|
| 6,047,076 | A * | 4/2000 | Yang | 381/381 |
| 7,013,018 | B2 * | 3/2006 | Bogeskov-Jensen | 381/381 |
| 7,613,315 | B2 * | 11/2009 | Vaerum et al. | 381/381 |
| 2006/0198543 | A1 | 9/2006 | Vaerum et al. | |
| 2007/0098201 | A1 | 5/2007 | Chen | |

FOREIGN PATENT DOCUMENTS

| | | |
|---|---|---|
| CN | 1484909 | 3/2004 |
| GB | 2096861 | 10/1982 |
| WO | WO 02/054825 | 7/2002 |
| WO | WO 2005/067654 | 7/2005 |

OTHER PUBLICATIONS

The First Office Action/Search Report issued by SIPO on Jun. 21, 2013 for CN application 200880131442.2.

* cited by examiner

*Primary Examiner* — Curtis Kuntz
*Assistant Examiner* — Joshua Kaufman
(74) *Attorney, Agent, or Firm* — Altera Law Group, LLC

(57) ABSTRACT

The earphone housing is essentially mirror symmetric about a first plane, which is orthogonal to the first side, and which extends through the wire position and the center of the earphone housing. The wearing device extends from the earphone housing at an attachment position, which lies at the upper end of the earphone housing. The attachment position can be a first attachment position for holding the earphone housing at the left ear or a second attachment position for holding the earphone at the right ear. The first and the second attachment positions are mirror symmetric located about the first plane.

27 Claims, 8 Drawing Sheets

WIRED HEADSET ADAPTABLE FOR LEFT AND RIGHT EAR USE

TECHNICAL FIELD

The disclosure relates to a wired headset comprising an earphone with an earphone housing and a wearing device for attaching the earphone housing to the head of the user so that it is held at the entry of a users ear during use, wherein the earphone housing enclosing a speaker and having a first side facing the users ear during use and an opposite second side facing away from the users ear during use, wherein the earphone further comprising a wire for connecting the earphone to external equipment, the wire extending from the earphone housing in an essentially downwards direction at a wire position at the lower end of the earphone housing during use, and wherein the earphone housing is essentially mirror symmetric about a first plane, which is orthogonal to the first side, and which extends through the wire position and the centre of the earphone housing, and wherein the wearing device being attached to the earphone housing, so that it extends from the earphone housing at an attachment position, which lies at the upper end of the earphone housing.

BACKGROUND

Wired headsets as defined above are typically used in offices, call centres and the like. The wire connects the headset with external equipment, such as a telephone, a computer or the like. The headset comprises at least one earphone and a wearing device for attaching the earphone to the head of the user, such that sound from the earphone speaker enters the ear canal.

Headsets and earphones can be secured to a user's head by different wearing devices. As examples, these can comprise a headband, a neckband, an "earring" surrounding the outer ear or an ear hook. Sometimes ear loop, ear hanger, or ear brace are used instead of the term ear hook. An ear hook is a curved or essentially C-shaped device, which is attached to a headset device, such as a headset housing, an earphone or the like. In order to mount the headset on the ear, the ear hook is arranged around the auricle, such that it partly encircles the root of the auricle and extends in the so-called post auricular sulcus. The term "root of the auricle" refers to the area of the outer ear where it protrudes from the side of the head. Postauricular sulcus is the depression behind the ear next to the head. The "auricle" is the externally visible cartilaginous structure of the external ear. Synonyms for auricle are "pinna" or "outer ear".

It is often desirable for the user to choose whether the earphone shall be placed at the left or the right ear.

U.S. Pat. No. 7,013,018 discloses a wired headset. The earring 2 of the headset is by means of a pivotal coupling link 6 connected to a holding ring 7, which holds an earphone housing 8. Due to the pivotal coupling link 6, the headset can be adapted from left ear use to right ear use or vice versa by turning the holding ring 7 approximately 180° in relation to the earring 2. When the headset is attached to the ear of a user, the earring 2 surrounds the outer ear and the coupling link 6 points forward. As the wire 10 leaves the earphone housing 8 directly opposite the coupling link 6, the wire points backwards. This causes a torque as the gravity exerts a downward force on an increased lever arm, which unbalancing the headset. If the wire-receiving notch in the holding ring 7—shown in FIG. 2 of U.S. Pat. No. 7,013,018—was located so that the wire was pointing downwards during use, this would only be the case when the headset is worn on the left or right ear. A turning through 180° of the holding ring 7 would cause the notch to point upwards.

SUMMARY

The object of the disclosure is to improve the prior art so that it can be adapted to be worn on either ear without unbalancing the headset. The headset according to the disclosure is characterized in that the attachment position is selectable between a first attachment position for holding the earphone at the left ear and a second attachment position for holding the earphone at the right ear, and that the first and the second attachment positions are mirror symmetric located about the first plane. In this way the wearing device can be adapted to left and right ear while the wire extending from the earphone in a downwards direction in both situations. By "extending in a downwards direction during use" it is assumed, that the user holds the head in a natural position. The user will, off course, occasionally move the head to positions, where the wire will not extend in a "downwards direction".

According to a preferred embodiment, the wearing device comprises a holding member, which is detachably attached to the periphery of the earphone housing.

The term "detachably" specifies that the holding member can be completely disassembled from the earphone housing or just be "disengaged" from the earphone housing without being disconnected from the earphone housing. In the latter case, the holding member can be disengaged from the earphone housing, moved in relation to the earphone housing and engaged again with the earphone housing.

The earphone housing may comprise a third side, which connects the first side and the second side of the earphone housing, and the wire position may be located on the third side.

According to a preferred embodiment, the holding member has an outline that corresponds to the outline of the headset housing and surrounds the earphone housing along the third side.

The holding member may be frame-shaped and comprising a surrounding wall, which surrounds a holding member opening, and which surrounds the earphone housing along the third side. This solution is a simple and robust construction.

Alternatively, the holding member is cup-shaped and comprising a surrounding wall, which surrounds the earphone housing along the third side, and which borders a bottom wall with sound openings. This embodiment has the advantage that the sound openings can be optimal adapted, whether the earphone is attached to the left or the right ear.

According to an embodiment, the surrounding wall comprises a first wire-receiving notch for receiving the wire, when the attachment position is the first attachment position, and a second wire-receiving notch for receiving the wire, when the attachment position is the second attachment position. Such a solution makes it easier for the user to attach the holding member to the earphone housing in a correct position as the wire and receiving notches functions as guides. Furthermore, the notches may prevent the holding member and the earphone housing from being displaced during use.

Preferably, the holding member comprises a marking for left ear use at the first wire-receiving notch and a marking for right ear use at the second wire-receiving notch. In this way, the user is not in doubt in which notch the wire should be placed, when he wants to wear the earphone on the left or right ear, respectively.

According to a preferred embodiment, the holding member and the earphone housing have interengaging locking members, which lock the holding member to the earphone housing. Alternatively, the holding member and the earphone housing may be attached to each other by pure friction.

The locking members may comprise protrusions and recesses in the earphone housing and holding member.

The protrusions may be ridges and the recesses grooves.

According to an embodiment, the earphone housing and the holding member are adapted, such that they can only be attached to each other, when the wearing device extends from the earphone housing in the first attachment position or the second attachment position. This prevents the user from attaching the holding member and the earphone housing to each other in an inappropriate way.

Preferably, the holding member and the earphone housing have corresponding circular outlines.

In this case, it is an advantage, if the earphone housing and the holding member are adapted, such that the locking members prevent them from rotating in relation to each other.

The earphone housing and the holding member may be adapted such, that in order to change the attachment position from the first attachment position to the second attachment position or vice versa, the holding member is detached from the earphone housing, turned about an axis through the centre of the earphone housing and perpendicular to the first side of the earphone housing and attached to the earphone housing again.

According to an alternative solution, the holding member and the earphone housing are adapted such, that in order to change the attachment position from the first attachment position to the second attachment position or vice versa, the holding member is detached from the earphone housing, turned 180° about an axis parallel with the first plane and the first side of the earphone housing and attached to the earphone housing again.

The earphone housing and the holding member may have an outline shaped essentially as a circle, an oval triangle, a rectangle, a circle, an oval or a polygon with five or more sides.

According to an embodiment, the wearing device comprises an ear hook or an earring. As these user engaging devices grips around a relatively large part of the outer ear, it is a particular advantage that the wearing device extends from the earphone housing in an upward and forward direction during use, such the hook or ring better can encircle the root of the outer ear.

However, the wearing device could also comprise a neckband or a headband.

According to an embodiment, the headset comprises a microphone. Thus, the headset can be used for two-way communication.

Preferably, the headset comprises a microphone arm. A better sound picking up can be obtained, as this will take place closer to the user's mouth.

Preferably, the microphone is arranged at the outer end of the microphone arm.

The microphone arm may extend from the earphone housing and preferably from the second side of the earphone housing.

In a preferred embodiment, the microphone arm is rotatably connected to the earphone housing, such that it can rotate about a rotational axis. In this way, the microphone arm may be directed to or away from the user's mouth, where the headset is mounted in the left or the right ear.

Preferably, the rotational axis lies in the first plane.

If the earphone housing is provided with a circular outline, the rotational axis may extend through the centre of the earphone housing.

The microphone arm may be able to rotate at least 90°, preferably at least 120°, more preferably at least 180°, in order to direct it against the user's mouth during use.

BRIEF DESCRIPTION OF THE DRAWINGS

The disclosure is explained in detail below with reference to the drawing illustrating a preferred embodiment of the disclosure and in which.

Figure 1:
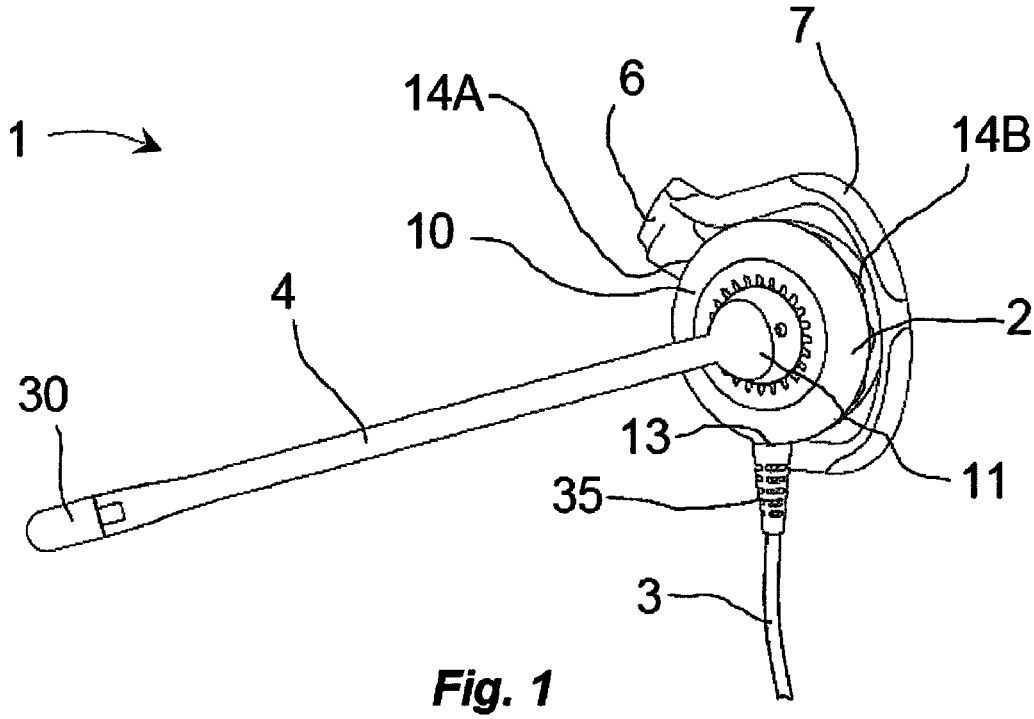
FIG. 1 is a perspective view of a first embodiment of headset according to the disclosure assembled for left ear use.

The following reference signs are used in the figures and the following detailed description of the preferred embodiment.

1 headset
2 earphone
3 wire
4 microphone arm
5 holding member
6 coupling member
7 ear hook
8 centre of earphone
9 first side of speaker housing
10 second side of speaker housing
11 base of microphone arm
12 earphone housing
13 wire position
14A first attachment position
14B second attachment position
15 speaker
16 latching ridge
17 latching groove
18 first corner of triangular holding member
19 second corner of triangular holding member
20 third corner of triangular holding member
21 third side of earphone housing
22 first wire receiving notch

23 second wire receiving notch
24 frame of holding member
25 opening in frame
26 bottom wall of cup-shaped holding member
27 sound openings in earphone housing
28 left ear use marking
29 right ear use marking
30 microphone
31 rotational axis of microphone arm
32 first plane
33 wearing device
34 sound opening in bottom wall of cup-shaped holding member
35 strain relief bushing
36 vent notch
37 triangular holding member
38 triangular earphone housing
39 coupling pin
40 coupling pin
41 coupling hole
42 protrusion on holding member
43 circular edge of holding member
44 air openings in speaker housing
45 through coupling hole
46 coupling hole
47 first side of holding member
48 wire notch in second side of holding member
49 symmetry plane of holding member
50 holding member
51 second side of holding member
A1 Rotational movement of microphone arm
A2 detachment of ear hook from coupling member
A3 attachment of ear hook to coupling member
A4 rotational movement of holding member Some of the reference signs are used for corresponding parts in the different embodiments

DETAILED DESCRIPTION

Figure 2:
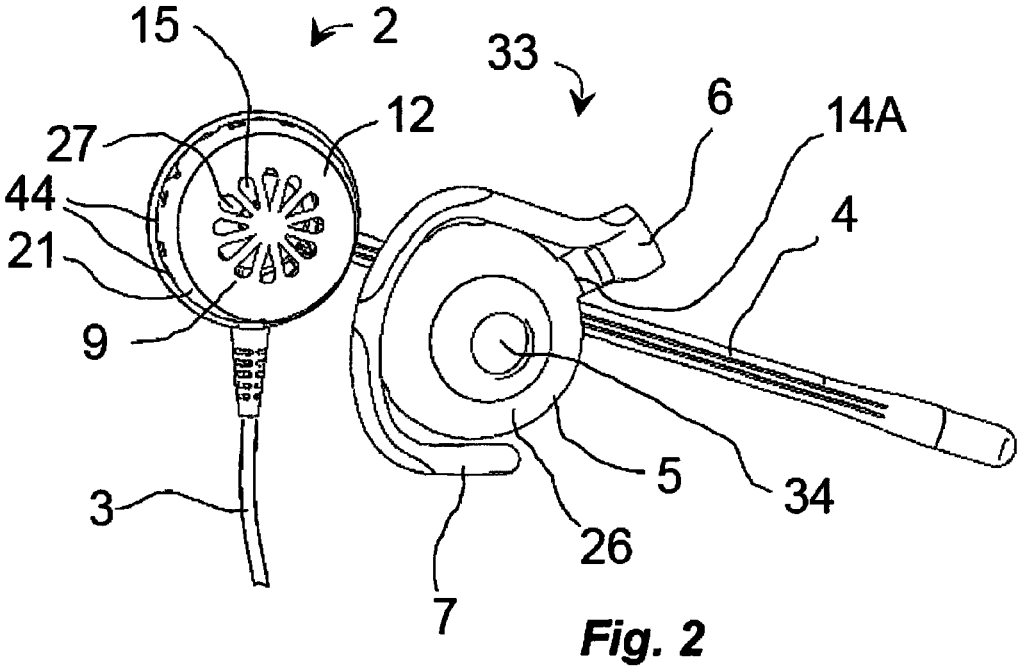
FIG. 2 is a perspective view of the first embodiment where the headset is disassembled into an earphone and a wearing device, FIG. 3 a side view of the first embodiment, assembled for left ear use, FIG. 4 an end view of the first embodiment, assembled for left ear use, FIG. 5 the same as shown in FIG. 2 seen from a different angle.

FIGS. 1 and 2 disclose a first embodiment of a headset 1 according to the disclosure. The headset 1 is a wired headset typically used in offices and call centres. The headset 1 is a mono headset with only one speaker and comprises an ear hook 7 to attach the headset around the outer ear of the user, and earphone 2 with a speaker, a microphone arm 4 and a wire 3 for connecting the headset 1 to an external device, such as a telephone, a computer with IP telephony or the like.

As shown in FIG. 2, the headset can be disassembled into the earphone 2 and a wearing device 33. The earphone 2 comprises an earphone housing 12, the wire 3 and the microphone arm 4. The earphone housing 12 comprises a first circular side 9 facing the user's ear during use and an opposite second circular side 10 (FIG. 1) facing away from the user's ear during use. A third circumferential side 21 connects the first side 9 and the second side 10. Sound openings 27 in the first side 9 lead sound from a speaker 15 in the earphone housing 12 to the user's ear. The microphone arm 4 extends from the second side 10 of the earphone housing 12. A microphone 30 is arranged at the distal end of the microphone arm 4 in order to pick up sounds from the users mouth. The wearing device 33 comprises the ear hook 7, a coupling member 6 and a holding member 5. The holding member 5 is circular and cup-shaped and comprises a bottom wall 26 with a sound opening 34. It is adapted to receive the first side 9 and the third side 21 of speaker housing 12. The holding member 5 and the earphone housing 12 can be locked together in different positions, which will be explained later. The ear hook 7 is attached to the holding device by means of the coupling member 6, which—in assembled state—extends in a direction away from the earphone housing 12 at a first attachment position 14A.

The headset can be adapted to be attached to the left or the right ear of the user. In FIG. 1, the headset is adapted to be attached to the left ear of the user. In order to secure the ear hook 7 properly around the root of the outer ear, the coupling member 6 should point forward (against the users face) and upward, so that the ear hook 7 can grip behind the outer ear and rest on the top of the root of the outer ear.

Figure 3:
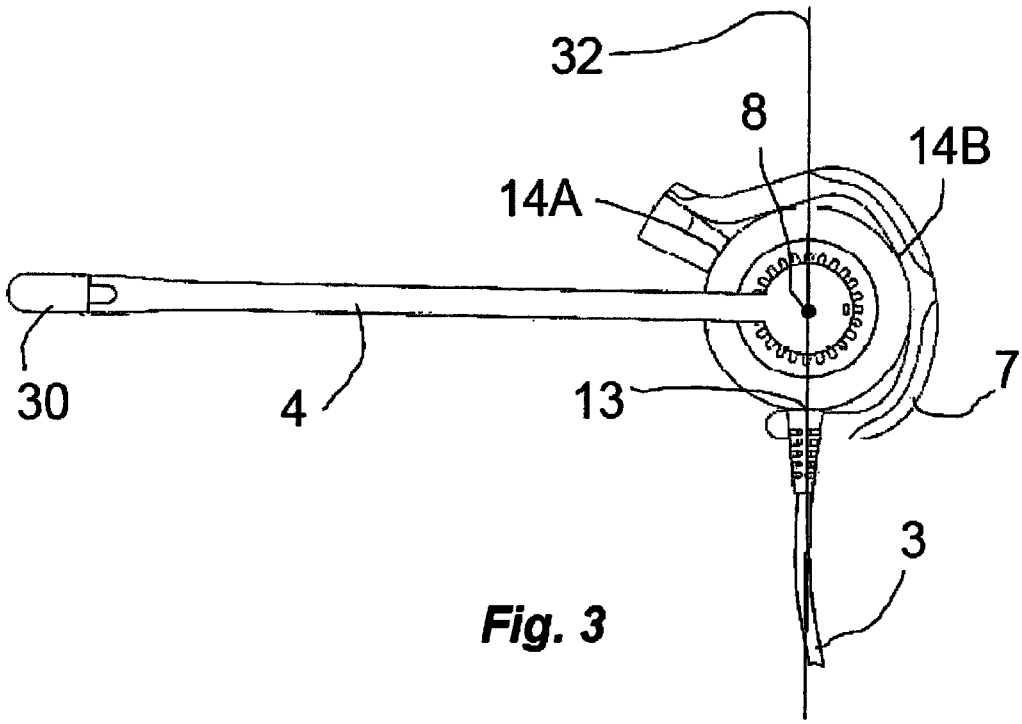

Irrespective of the headset 1 being worn on the left or the right ear, it is desirable that the wire extends essentially downwards in order not to un-balance the headset during use. FIG. 3 discloses the headset from the side. The wire position 13, at which the wire 3 extends from the earphone housing 12, lies in a vertical plane 32, which also comprises the centre 8 of the earphone housing 12. As the wire position 13 lies in this plane 32 and extends vertical downwards during use, it exerts a uniform force from its own weight and tension on the headset 1.

At its base 11, the microphone arm 4 is rotatable mounted on the outer second side 10 of the earphone housing 12, so that it can rotate about a rotational axis 31 (see FIG. 4), which is essentially perpendicular to the second side 10 and goes through the centre 8 of the earphone housing 12.

Figure 4:
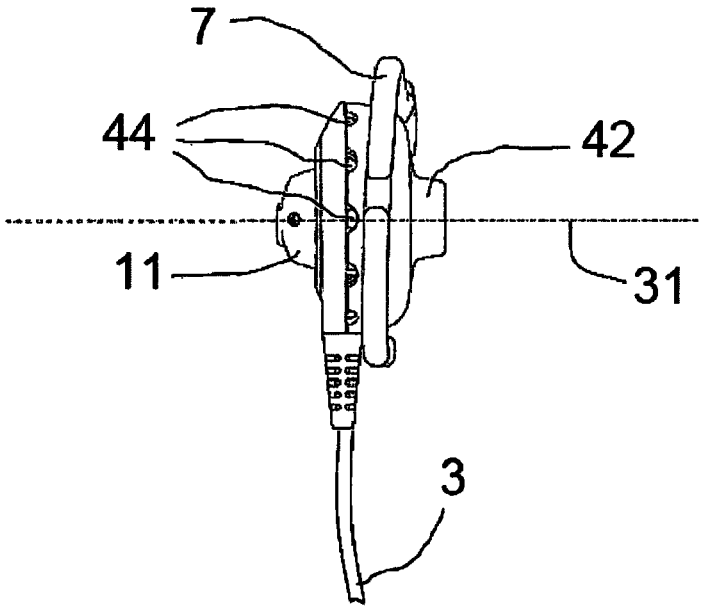

FIG. 4 discloses the headset from behind. The ear hook is made of flexible material and is therefore able to flex away from the earphone 2, when it is arranged around the root of the outer ear. The holding member 5 comprises a protrusion 42 that encircles the sound opening 34 and enters the concha of the ear. This provides a better guidance of the sound from the speaker to the user's ear canal.

Figure 5:
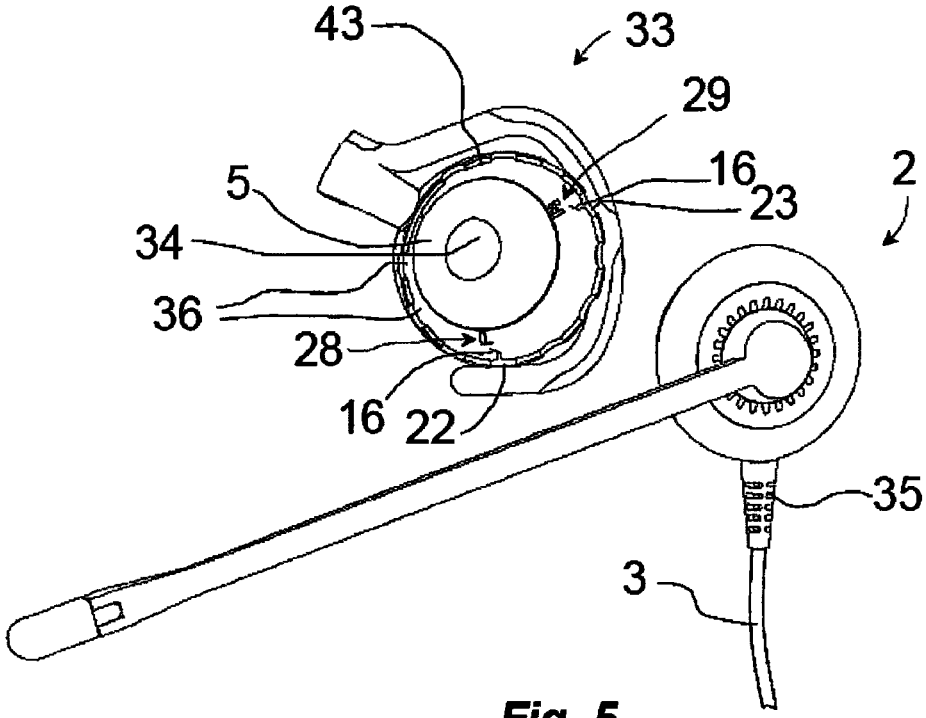
Figure 6:
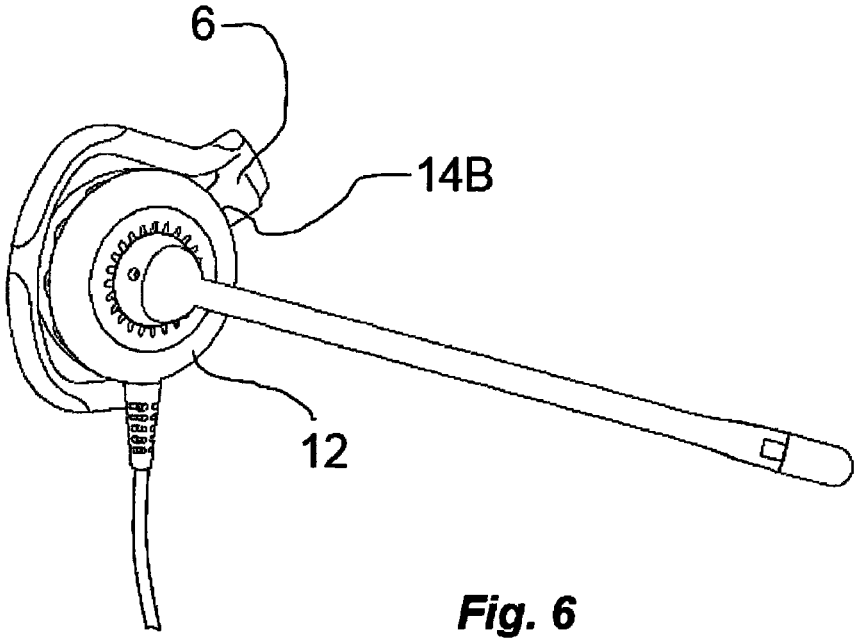
FIG. 6 is a perspective view of the first embodiment assembled for right ear use.

FIGS. 5 and 6 disclose the headset 1 in disassembled condition wherein the inner side of the cup-shaped holding member 5 is visible. Along its circular edge 43, the holding member 5 has a number of vent notches 36, which serve to connect air openings 44 (see FIGS. 2 and 4) in the speaker housing 12 to the surroundings. These air openings 44 are correspondingly arranged along the third side 21 of the speaker housing 12 and serve to provide air channels to the backside of the membrane of the speaker 15.

The circular edge 43 also has two wire-receiving notches 22, 23, which are shaped as the vent notches. As shown in FIG. 5, the wire-receiving notch 22 has a "L"-marking 28 and must be selected when the headset 1 is worn on the left ear. Thus, if the earphone 2 and the wearing device 33 are assembled in the mutual rotational position shown in FIG. 5, the strain relief bushing 35 of the wire 3 will be received in the notch 22, which means that the headset 1 will be adapted for left ear use. If the user wants to wear the headset on the right ear, he disassembles the earphone 2 and the wearing device 33, rotates them in relation to each other to the mutual rotational position shown in FIGS. 7 and 8 and assembles them again. Latching ridges 16 on the inner side of the holding member 5 and corresponding latching grooves 17 (see FIG. 7) on the third side 21 of the earphone housing 12 ensures, that the holding member 5 and the earphone housing 12 only can be assembled correctly in the two shown positions. Furthermore, the latching ridges 16 and the latching grooves 17 are adapted as latching members, which lock the parts 12, 5 together.

In FIG. 6, the headset is assembled for right ear use. Here, the coupling member 6 extends in a direction away from the earphone housing 12 at a second attachment position 14B.

Figure 7:
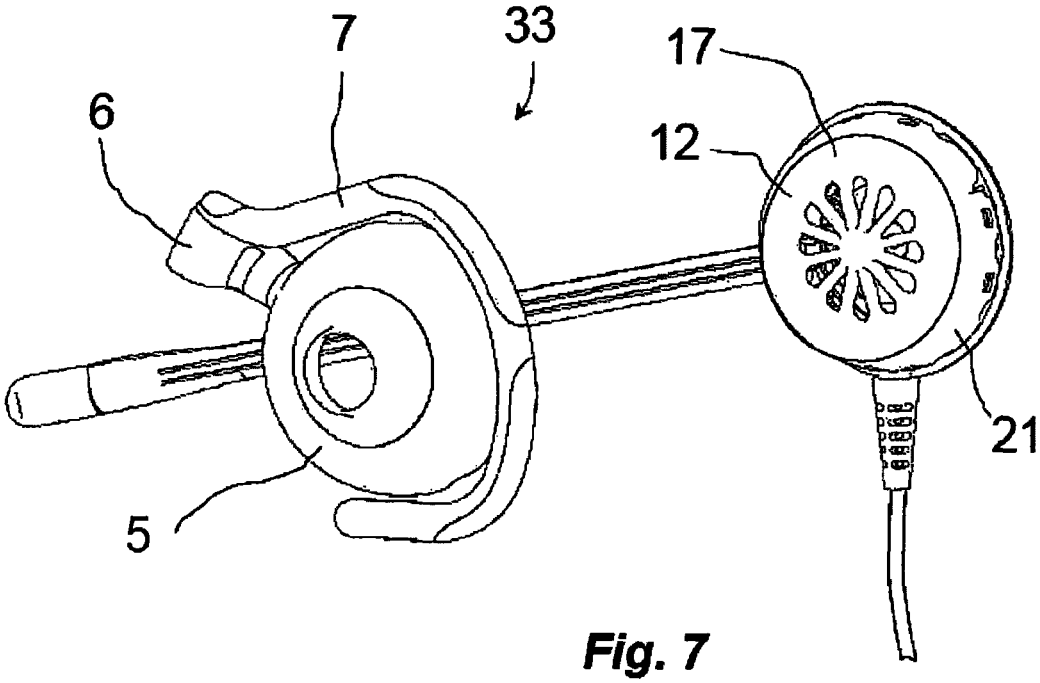
FIG. 7 is a perspective view of the first embodiment disassembled into the earphone and the wearing device, FIG. 8 the same as shown in FIG. 7 seen from a different angle, FIG. 9 a schematically side view of a second embodiment of the disclosure assembled for left ear use, FIG. 10 the same as in FIG. 9 seen from another side, FIG. 11-16 schematically side views of different steps in adapting the headset according to the second embodiment from left ear use to tight ear use, FIG. 17 a schematically side view of a third embodiment of a headset according to the disclosure, FIG. 18 a schematically side view of a wearing device of the third embodiment, and FIG. 19 a schematically side view of a fourth embodiment of a headset according to the disclosure, FIG. 20 a schematically side view of a fifth embodiment of a headset according to the disclosure, and FIG. 21 the holding member of an alternative embodiment.
Figure 8:
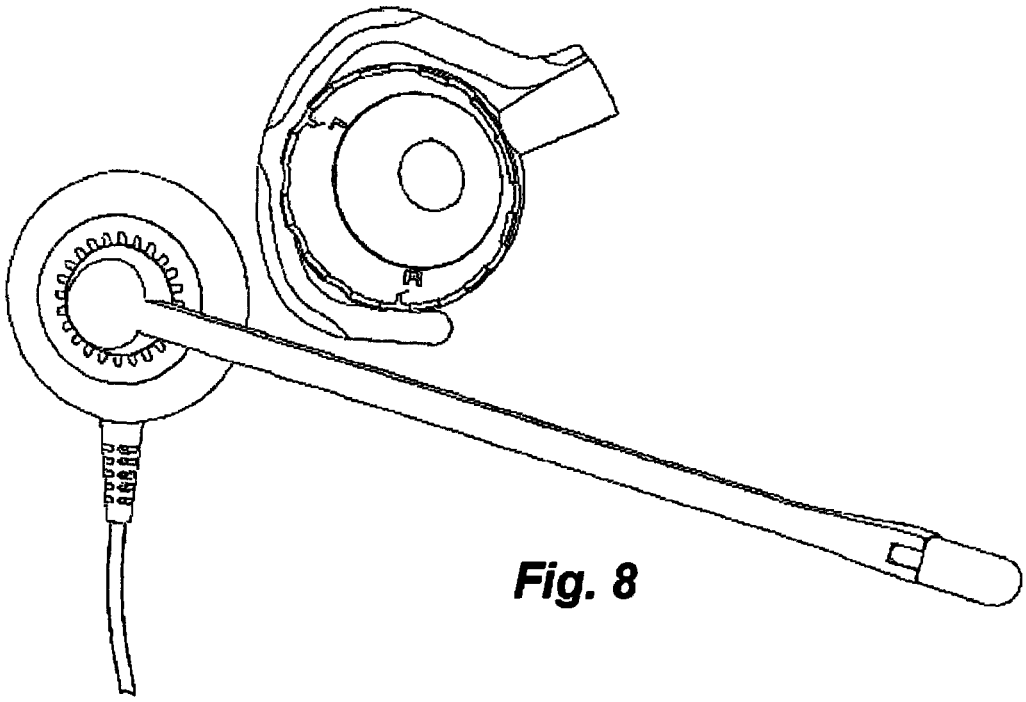

In FIGS. 7 and 8, the earphone housing 12 and the wearing device 33 are disassembled but in mutual rotational position for right ear use.

The ear hook 7 is attached to the coupling member 6, which protrudes radially from the outer side of the holding member 5.

The proximal end of the ear hook comprises a not shown coupling pin, which frictionally engages a not shown through-going coupling hole in the coupling member 6. The pin and hole have non-circular cross-sections, so that they cannot rotate in relation to each other. When the earphone housing 12 and the holding member 5 are disassembled and mutual rotated in order to adapt the headset form left ear use to right ear use or vice versa, the user must also pull the coupling pin out of the ear hook 7 out of the coupling hole and insert it again from the opposite side. This is shown in more detail in FIGS. 12 and 13.

When the headset is changed from left ear use to right ear use or vice versa, the microphone arm 4 must be rotated about the axis 31 in order to point in the direction of the user's mouth during use.

Figure 9:
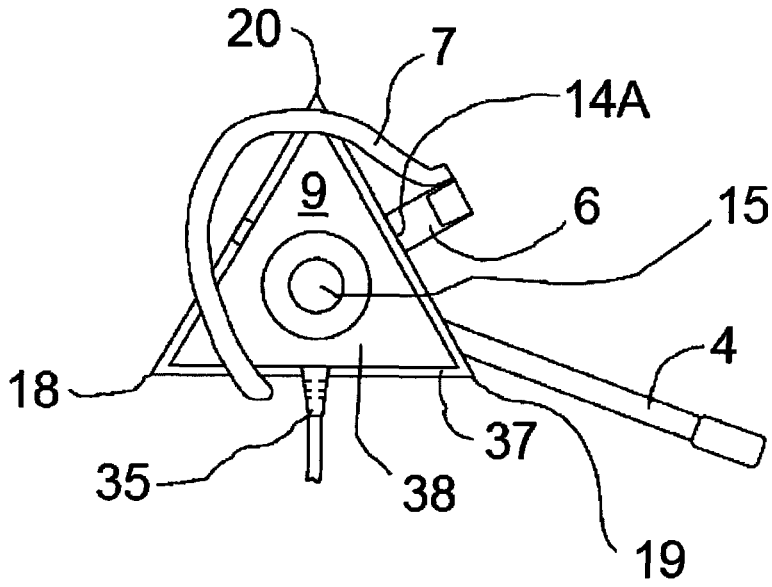
Figure 10:
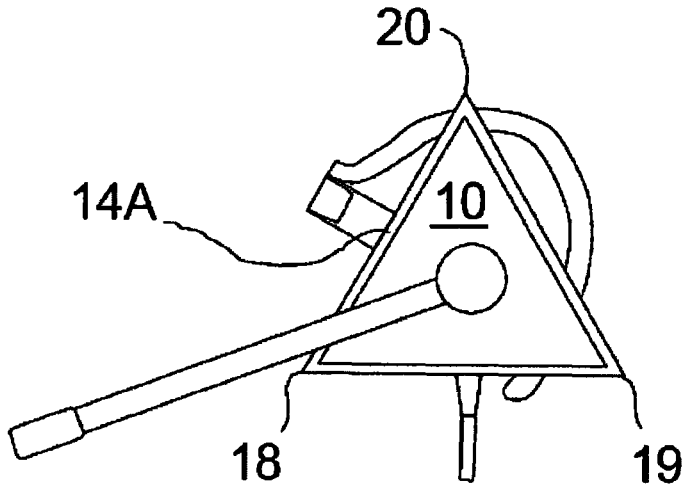

FIGS. 9-16 disclose a second embodiment, which essentially differs from the first embodiment by the earphone housing 38 and the holding member 37 having corresponding triangular outlines. FIG. 9 discloses the headset from the "ear side" and adapted for left ear use. FIG. 10 discloses the headset 1 from the outer side. The holding member 37 is frame shaped, which means it does not have a bottom wall but a large through going frame opening 25. The triangular holding member 37 has a first corner 18, a second corner 19 and a third corner 20.

Figure 11:
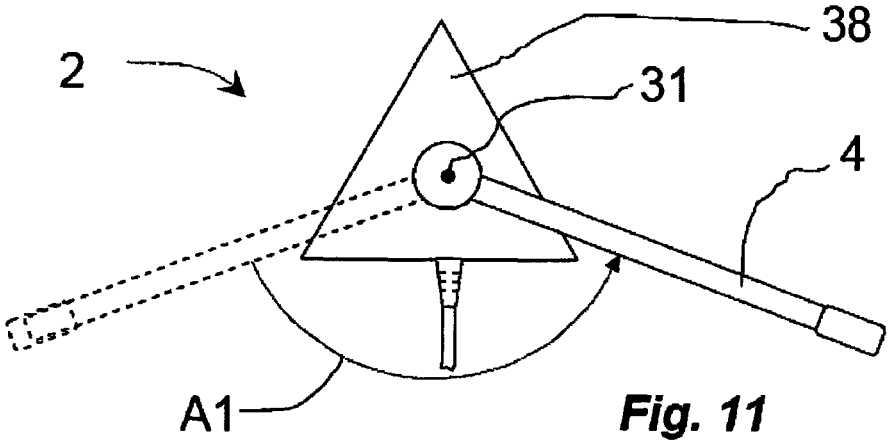
Figure 12:
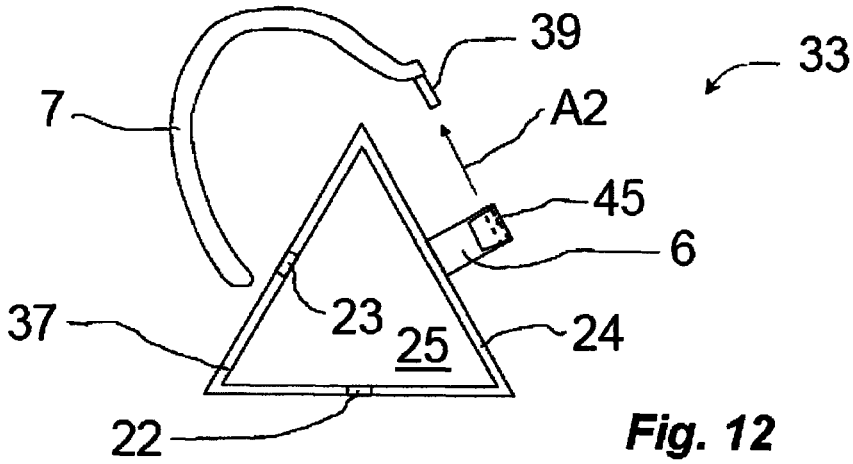
Figure 13:
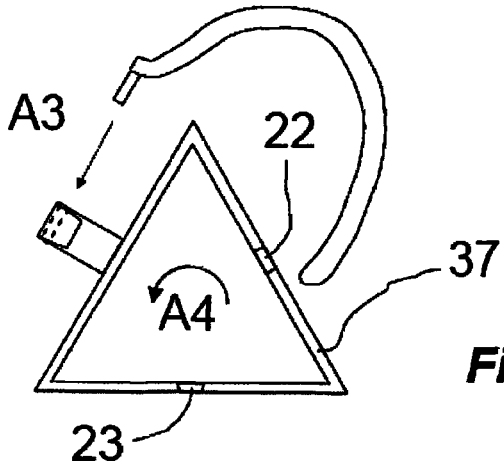
Figure 14:
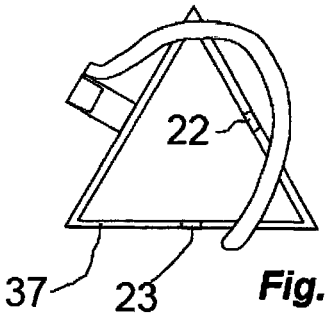
Figure 16:
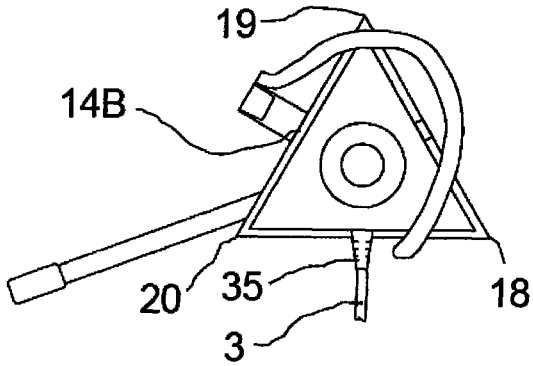

If the user wants to change the headset 1 from left ear use to right ear use, he follows the steps explained below.

a) He disassembles it into the earphone 2 and wearing device 33 as explained earlier by pulling the earphone 2 and the wearing device 33 away from each other in the direction perpendicular to the first side 9 of the earphone housing 38. FIG. 11 discloses the earphone 2 alone.

b) The microphone arm 4 is rotated in the direction of the arrow A1 from the position shown with dotted line to the position shown with solid line in FIG. 11.

c) The ear hook 7 is detached from the coupling member 6 by pulling a coupling pin 39 in the direction of the arrow A2 out of a through-going hole 45 in the coupling member 6, see FIG. 12.

d) The holding member 37 is rotated 120° in the direction of the arrow A4, see FIG. 13.

e) The ear hook 7 is attached to the coupling member 6 by pushing the coupling pin 39 in the direction of arrow A3 into the through-going coupling hole 39 in the coupling member 6, see FIG. 13.

f) The earphone 2 and the wearing device 33 are assembled by pushing them together in a direction perpendicular to the plane of the paper. Hereby, the strain relief bushing 35 of the wire 33 engages the wire notch 23. Simultaneously, not shown locking members lock the holding member 37 and the earphone housing 38 together. FIG. 16 shows the headset 1 ready for right ear use.

Figure 15:
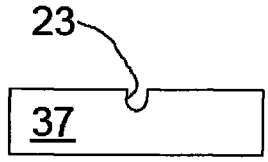

FIG. 15 discloses the holding device 37 seen from below, and the outline of the wire-receiving notch 23 is shown.

Figure 17:
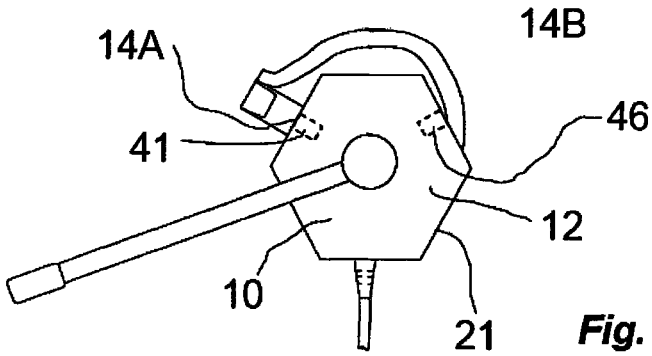

FIG. 17 discloses a third embodiment. This embodiment has an earphone housing 12 with a hexagonal outline and differs further from the first and the second embodiments by not having a holding member. Instead, the third side 21 of the earphone housing 12 is provided with two radially coupling holes 41, 46, which can receive a coupling pin 40 on the coupling member 6. Thus, the coupling hole 41 to the left in FIG. 17 is used, when the headset 1 is adapted for left ear use, and the coupling hole 46 to the right in FIG. 17 is used, when the headset 1 is adapted for right ear use.

Figure 18:
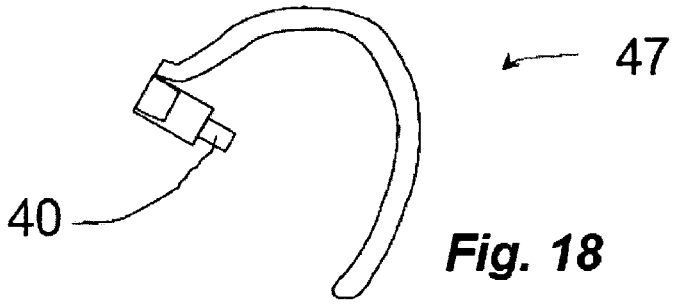

FIG. 18 discloses the wearing device 47 of the third embodiment, and the coupling pin 40 of the wearing device is clearly shown. The coupling pin 40 is locked in the coupling holes 41, 46 by pure friction, but could alternatively be provided with some kind of spring-loaded latching means.

Figure 19:
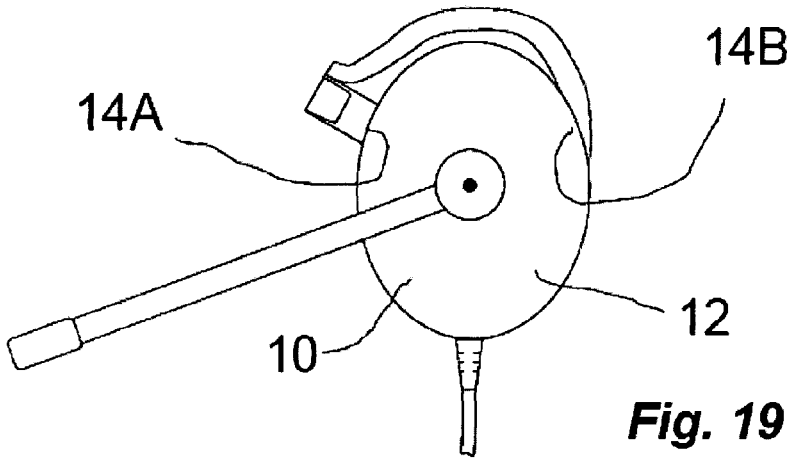

FIG. 19 discloses a fourth embodiment, which differs from the third embodiment by having an earphone housing 12 with an oval outline.

Figure 20:
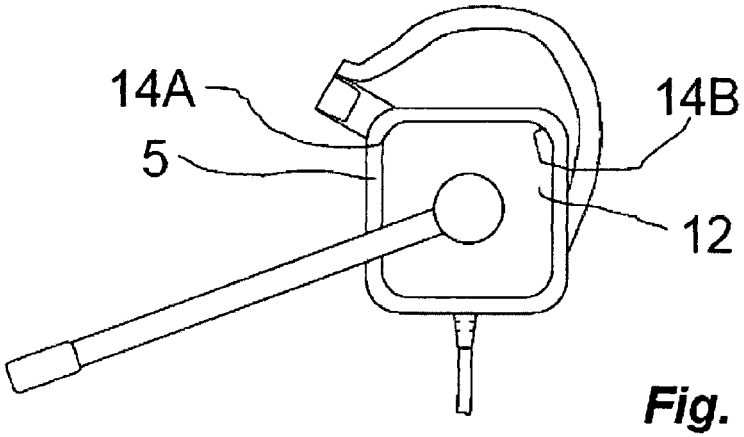

FIG. 20 discloses a fifth embodiment, which has an earphone housing 12 with a rounded square outline and a correspondingly shaped holding member 5.

Figure 21:
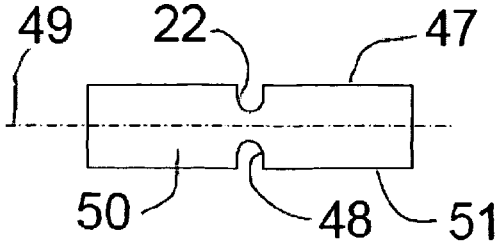

In all the shown embodiments, the holding device is rotated about an axis 31 through the centre 8 of the earphone housing 12 and perpendicular to the first side 9 of the earphone housing (12; 38). FIG. 21 discloses an alternative variant, wherein the holding member 50 is turned 180° about an axis parallel with the first plane 32 (see FIG. 3) and the first side 9 of the earphone housing 12, 37 and attached to the earphone housing 12, 37 again in order to switch from left ear use to right ear use. In this case, the first wire notch 22 is centrally arranged in first side 47 of the holding member 50 and the second notch 46 is centrally arranged in the second side 51 of the holding member 50. The holding member 50 is able to receive the earphone housing from both the first side 47 and the second side 51 and can therefore not be cup-shaped as the first embodiment. The variant shown in FIG. 21 can be applied to the second and the fifth embodiments, which comprise holding members.

All the embodiments shown here are provided with an ear hook. However, the ear hook could be replaced by an earring or a neckband.

In the second embodiment, the coupling member 6 and the wire receiving notches 22, 23, 46 are arranged centrally on the sides of the triangle. However, they could also be positioned in the corners. This applies to the third and fifth embodiment also.

In all the embodiments the wearing device extends from the earphone housing by means of the coupling member 6, whereby the attachment position 14A, 14B of the earphone housing 12, 37 is defined by the position of this coupling member 6. However, a separate coupling member 6 is not necessary. As an example, the ear hook could be directly connected to or integrally formed with the holding member, or directly inserted into a coupling hole in the earphone housing. The essence is that the attachment position is a position, where the wearing device extends away from the outline or periphery of the earphone housing.

In the shown embodiments, there is only on "pair" of attachment positions 14A, 14B. This is preferred, as it makes it easy for the user to assemble the headset. There is only one attachment position 14A for left ear use and one attachment position 14B for right ear use. However, the headset could be provided with two or more "pairs", which would enhance the adjustability for the individual at the prize of user friendliness. Thus, the holding member 5 and the earphone housing 12 could be adapted to be assembled in four, six or even eight positions, i.e. two, three or four different positions for each ear. In addition, the embodiments without at holding member could be provided with an even number of attachment positions.

The invention claimed is:

1. A wired headset comprising an earphone with an earphone housing and a wearing device for attaching the earphone housing to the head of the user so that it is held at the entry of a user's ear during use, wherein the earphone housing enclosing a speaker and having a first side facing the user's ear during use and an opposite second side facing away from the user's ear during use, wherein the earphone further comprising a wire for connecting the earphone to external equipment, the wire extending from the earphone housing in a generally downwards direction, thereby defining a wire axis, at a wire position at the lower end of the earphone housing during use, and wherein the earphone housing is generally mirror symmetric about a first plane, which is orthogonal to the first side, and which extends through the wire position and the centre of the earphone housing, and wherein the wearing device extending from the earphone housing at an attachment position, which lies at the upper end of the earphone housing, wherein the attachment position is selectable between a first attachment position for holding the earphone housing at the left ear and a second attachment position for holding the earphone at the right ear, and that the first and the second attachment positions are mirror symmetric located about the first plane and substantially off the wire axis.

2. A headset according to claim 1, wherein the wearing device comprises a holding member, which is detachably attached to the periphery of the earphone housing.

3. A headset according claim 2, wherein the earphone housing comprises a third side, which connects the first side and the second side of the earphone housing, and wherein the wire position is located on the third side.

4. A headset according to claim 3, wherein the holding member has an outline that corresponds to the outline of the headset housing and surrounds the earphone housing along the third side.

5. A headset according to claim 4, wherein the holding member is frame-shaped and comprising a surrounding wall, which surrounds a holding member opening; and which surrounds the earphone housing along the third side.

6. A headset according to claim 4, wherein the holding member is cup-shaped and comprising a surrounding wall, which surrounds the earphone housing along the third side, and which borders a bottom wall with a sound opening.

7. A headset according to claim 5, wherein the surrounding wall comprises a first wire receiving notch for receiving the wire, when the attachment position is the first attachment position, and a second wire receiving notch for receiving the wire, when the attachment position is the second attachment position.

8. A headset according to claim 7, wherein the holding member comprises a marking for left ear use at the first wire receiving notch and a marking for right ear use at the second wire receiving notch.

9. A headset according to claim 2, wherein the holding member and the earphone housing have inter engaging locking members, which lock the holding member to the earphone housing.

10. A headset according to claim 9, wherein the locking members comprise protrusions and recesses in holding member and the earphone housing.

11. A headset according to dam 10, wherein protrusions are ridges and the recesses are grooves.

12. A headset according to claim 2, wherein the earphone housing and the holding member are adapted, such that they can only be attached to each other, when the wearing device extends from the earphone housing in the first attachment position or the second attachment position.

13. A headset according to claim 2, wherein the holding member and the earphone housing have corresponding circular outlines.

14. A headset according to claim 13, wherein the earphone housing and the holding member are adapted, such that the locking members prevent them from rotating in relation to each other.

15. A headset according to claim 2, wherein the holding member and the earphone housing are adapted such, that in order to change the attachment position from the first attachment position to the second attachment position or vice versa, the holding member is detached from the earphone housing, turned about an axis through the centre of the earphone housing and perpendicular to the first side of the earphone housing and attached to the earphone housing again.

16. A headset according to claim 5, wherein the holding member and the earphone housing are adapted such, that in order to change the attachment position from the first attachment position to the second attachment position or vice versa, the holding member is detached from the earphone housing, turned 180° about an axis parallel with the first plane and the first side of the earphone housing and attached to the earphone housing again.

17. A headset according to claim 15, wherein the earphone housing and the holding member have an outline shaped essentially as a circle, an oval, a triangle, a rectangle, a circle, an oval or a polygon with five or more sides.

18. A headset according to claim 1, wherein the wearing device comprises an ear hook or an earring.

19. A headset according to claim 1, wherein the microphone arm extends from the second side of the earphone housing.

20. A headset according to claim 19, wherein the microphone arm is rotatably connected to the earphone housing, such that it can rotate about a rotational axis.

21. A headset according to claim 20, wherein the rotational axis lies in the first plane.

22. A headset according to claim 21, wherein the rotational axis extends essentially through the centre of the earphone housing.

23. A headset according to claim 22, wherein the microphone arm is able to rotate at least 90°, preferably at least 120°, more preferably at least 180°, in order to direct it against the user's mouth during use.

24. A wired headset comprising an earphone with an earphone housing and a wearing device for attaching the earphone housing to the head of the user so that it is held at the entry of a user's ear during use, wherein the earphone housing enclosing a speaker, said housing having a first side facing the user's ear during use and an opposite second side facing away from the user's ear during use, wherein the earphone further comprising a wire for connecting the earphone to external equipment, the wire extending from the earphone housing in a generally downwards direction, thereby defining a wire axis, at a wire position at the lower end of the earphone housing during use, and wherein the earphone housing is generally mirror symmetric about a first plane, which is orthogonal to the first side, and which generally extends through the wire position and the center of the earphone housing, and wherein the wearing device is configured to engage said earphone housing at least one pair of attachment positions, said positions being generally mirror symmetric about said plane; one to the right of said plane and the other which is to the left of said plane, said wearing device including a holding ring member and a coupling link, said link extending generally radially away from said device and being substantially off the wire axis and including a through-going coupling aperture and thus having a first and second openings at opposite ends;

an ear hook including a coupling pin sized to be received within said aperture in either end;

wherein said headset can be switched for use between a user's left and right ear by moving said wearing device from one position to its mirror symmetric position on the other side of the plane and inserting the earhook into the other end of said aperture, so that the wire remains, at all times, extending downward regardless of which ear the headset is worn.

25. The headset of claim 24 wherein said holding ring includes a receiving notch and wherein said earphone is configured to engage said notch to prevent rotation between the earphone and ring.

26. The headset of claim 25 wherein said notch is collinear with said wire.

27. A method of making a headset with a reversible ear hook which maintains a signal supply wire in vertical orientation regardless of which ear the headset is worn, said wire located along a line generally bisecting the headset into left and right portions, thereby defining a wire axis, comprising the steps of:

a. providing an earphone having a notch generally collinearly aligned with said wire, b. providing a holding member having an earhook and a coupling pin, said holding member having at least one pair of engagement points selectively alignable with said wire notch, c. providing a coupling link extending radially away from said holding member and located substantially off the wire axis, d. creating a through going coupling hole in said link for receiving an ear hook from either end of the hole, e. engaging said holding member with said earphone on one of said engagement points for a user's right ear and the other of said points for user's left ear and switching said earhook from engaging one end of said through going hole for one ear and the other end of said hole for the other ear, so that said headset can be switched from a user's right or left ear while the wire remains generally vertically oriented whether used on the right or left ear.

* * * * *